United States Patent [19]

Püttmann et al.

[11] Patent Number: 4,953,626

[45] Date of Patent: Sep. 4, 1990

[54] RAM BORING MACHINE HAVING A PULL-AND-TURN REVERSING GEAR

[75] Inventors: Franz-Josef Püttmann; Alfons Hesse, both of Lennestadt, Fed. Rep. of Germany

[73] Assignee: Paul Schmidt, Lennestadt, Fed. Rep. of Germany

[21] Appl. No.: 306,033

[22] Filed: Feb. 2, 1989

[30] Foreign Application Priority Data

Mar. 10, 1988 [DE] Fed. Rep. of Germany ..... 3807831

[51] Int. Cl.[5] ..... B25D 9/00

[52] U.S. Cl. ..... 173/91; 173/90; 173/134; 175/19

[58] Field of Search ..... 173/90, 91, 134, 137; 175/19

[56] References Cited

U.S. PATENT DOCUMENTS 4,629,008 12/1986 Kostyler et al. ..... 173/91

4,662,457 5/1987 Bouplon ..... 173/91

*Primary Examiner*—Frank T. Yost

*Assistant Examiner*—Willmon Fridie, Jr.

*Attorney, Agent, or Firm*—Toren, McGeady & Associates

[57] ABSTRACT

A ram boring machine having a pull-and-turn reversing gear which comprises a striking piston axially displaceable in a tubular housing and a rotatably mounted control pipe with control openings such that forward and backward movement of the machine is controlled by moving the control openings over corresponding radial control openings in the striking piston, the control pipe having at least two parts with the rear part (viewed in the ramming direction) being connected to a supply hose, being relieved of the working pressure, and being connected to the bearing pipe by way of a force-loaded locking device which can be unlocked axially by traction on the supply hose against the loading force. This arrangement on the one hand prevents undesired reversal and on the other hand enables reversal to be effected under pressure.

14 Claims, 7 Drawing Sheets

RAM BORING MACHINE HAVING A PULL-AND-TURN REVERSING GEAR

TECHNICAL FIELD AND PRIOR ART

The invention relates to a ram boring machine or pneumatic rammer having a striking piston axially displaceable in a tubular housing and a control pipe rotatably mounted in a tubular bearing and having control openings such that forward and backward movement of the machine is controlled by moving the control openings over corresponding radial control openings located in the striking piston.

A ram boring machine of this kind is known from German Patent 26 34 066. When changing the direction of movement of the striking piston the supply hose must be turned through about 90° in order to turn the control pipe inside a rigid, i.e. fixed, control sleeve of the tubular bearing or bearing pipe and thus to close specific control openings in the control sleeve and the control pipe for the respective forward or backward movement. To change from the forward to the backward movement setting and vice versa the compressed air must, however, first be shut off temporarily so as to relieve the control pipe of the force of the compressed air.

It is also necessary in the case of a ram boring machine disclosed in German Patent 21 05 229 to interrupt the compressed air supply in order to change direction. This machine has a reversing gear with a fixed control sleeve with control openings in which an axially and rotatably adjustable valve slide in the form of a control pipe with corresponding control openings is mounted rotatably. The control pipe is thus influenced on the one hand by the compressed air and on the other hand by an adjusting spring. This has the disadvantage that the slide setting in operation is dependent upon whether and possibly to what extent the force exerted by the compressed air or the spring tension prevails. In addition both forces are not at all constant, because in operation the compressed air pressure is subject to fluctuations and the spring tension alters with time. The slide effecting the change in direction therefore does not take up a definite position in operation and is in addition displaced each time the machine is turned on.

Furthermore, both the rotational and the axial movement of the control pipe are controlled through a projection on the control pipe by a zigzag groove in the fixed control sleeve. This has the result that when the machine is not in operation or when the compressed air is shut off, or in case of a drop in pressure, the control pipe automatically turns and is displaced axially under the influence of the adjusting spring. Consequently when there is not enough compressed air pressure or when the compressed air is shut off, or in breaks in operation, the control pipe always assumes an intermediate position, which leads to operating difficulties and, when the compressed air is turned on, causes the control pipe to first move into the forward or the reverse movement setting. It is not possible for the operator to predict which of the two operating positions it will be in: this can only be recognised by the movement of the machine or, when the machine is underground, if need be from the movement of the hose.

OBJECT OF THE INVENTION

It is the object of the invention to provide a ram boring machine which does not have the disadvantages of the known machines, and which on the one hand prevents undesired changes in direction while on the other hand allowing reversal under pressure.

SUMMARY OF THE INVENTION

This object is achieved according to the invention by means of a ram boring machine of the kind described in the introduction that has a multipart control pipe whose rear part (viewed in the ramming direction) connected to the supply hose is relieved of the operational pressure and is connected to the bearing pipe via a force loaded locking device axially unlockable by traction on the supply hose counter to the loading force. By means of the multipart, preferably two-part, control pipe according to the invention a purely mechanical pull-and-turn reversal is obtained which enables the striking direction of the striking piston to be changed without interrupting the pressure medium, preferably compressed air.

The two-part control pipe advantageously makes it possible to hold the front part of the control pipe so that it cannot be displaced axially but can, however, rotate in the bearing pipe. This may for example be done by means of a safety clamp which does not prevent rotation and radially encloses the control pipe, e.g. engaging in a peripheral groove, or a locking ring. Two pins spaced apart and inserted through bores in the bearing pipe can also engage tangentially in a circumferential groove in the control pipe. The working pressure is thus totally absorbed by the front part of the control pipe or the locking device ensuring the axially non-displaceable position of this part, so that the working pressure cannot be transmitted to the reversing gear or the locking device of the rear part of the control pipe, which will hereafter be termed the "hose coupling". In addition, the working pressure can no longer cause unintentional unlocking, in contrast to the machine known from the German Patent 21 05 229, in which this possibility cannot be excluded when the spring is compressed.

Furthermore, in order to release the locking device and to change direction by rotating the hose coupling only the force acting on the locking device, which is considerably smaller than the working pressure, has to be overcome. Owing to the two-part control pipe, on the one hand the front part of the control pipe, provided with the control openings, cannot be displaced unintentionally by axial traction of any kind, and on the other hand the respective working position is not dependent on the pressure of the compressed air or on a balance between the compressed air pressure and an adjusting spring. If need be the hose coupling could be slightly axially displaced without this causing a change in direction as this requires not only axial traction but also rotation of the hose coupling.

The force acting on the locking device can advantageously be applied by a spring, or alternatively by pressure prevailing in a pressure chamber arranged in an annular space between the bearing pipe and the hose coupling: furthermore a combination of spring- and pressure-loading can also be used. The use of a spring has the advantage that even when the machine is turned off, i.e. if there is no compressed air available, the locking device is force-loaded and thus a firm connection between the bearing pipe and the control pipe is ensured. By combining pressure-loading with the spring, reduction in the spring tension which may occur with time during operation of the ram boring machine and under external influences can be compensated. The tractive force to be applied by an operator for axial unlocking can thus be held constant.

The locking device can comprise axial lugs on the control pipe projecting in the ramming direction and grooves in the bearing pipe corresponding to the lugs, advantageously with a ring or collar arranged nonrotatably on the hose coupling having two lugs, preferably a stop lug and a diametrically opposed locking lug tht does not project as far. Detent grooves and recesses ending axially deeper than the detect grooves in the front annular surface of the bearing pipe are advantageously associated with the lugs. Instead of arranging both lugs on a ring, as is preferred, the stop lug and the locking lug can be separated from one another, for example the locking lug can be arranged on a separate ring on the hose coupling or at some position on the control pipe. In each case associated with the locking lug are always at least two detent grooves offset from one another by an angle of about 90° which define the change between the forward and reverse movement positions of the striking piston of the ram boring machine.

The outer edges of the recess can advantageously form stops for the stop lug limiting the rotation of the control pipe. This ensures that in each end position of the stop lug one of the two detent grooves is in alignment with the locking lug so that the angular position of the control pipe necessary for the respective direction of stroke of the striking piston does not first of all have to be sought with difficulty. Simple and problem-free changes in direction are also achieved through the different lengths of the lugs and through the detent grooves for the locking lugs not being as deep as the recess. Thus when the shorter locking lug has already emerged axially from the detent groove, which can preferably be ensured by an end position limit for the axial stroke of the hose coupling, the stop lug still projects into the recess so as to ensure that on turning the hose coupling the lug strikes the outer edge of the recess limiting the rotation.

The bearing pipe can preferably be mounted at its rear end (viewed in the ramming direction) in a cylindrical resilient block provided with axial vent holes and preferably formed as an elastic ring and having at least one separating slit extending over the entire length of the ring. When the ram boring machine is in operation the elastic ring absorbs unavoidable shaking and vibration and thus keeps these influences as far as is possible from the reversing gear. The axial separating slit, or an elastic block comprising two half rings, makes possible on the one hand considerably easier assembly and on the other hand a reduction in the manufacturing costs. The elastic ring consisting, for example, of rubber or plastics material merely needs to be either spread out radially by means of its separating slit and fitted over the bearing pipe, or two half-rings need only be placed up against the outer surface of the pipe and a screw joint, which is in many cases required for the assembly of the ram boring machine, then be pushed over the elastic ring. The screw joint holds the elastic ring in its fitted position.

The control pipe or the reversing gear is thus located in an elastic element, i.e. it is suspended resiliently in the housing.

BRIEF DESCRIPTION OF THE DRAWINGS

The invention will now be explained in more detail with reference to exemplary embodiments shown in the drawings, in which.

DETAILED DESCRIPTION OF PREFERRED EMBODIMENTS OF THE INVENTION

Figure 1:
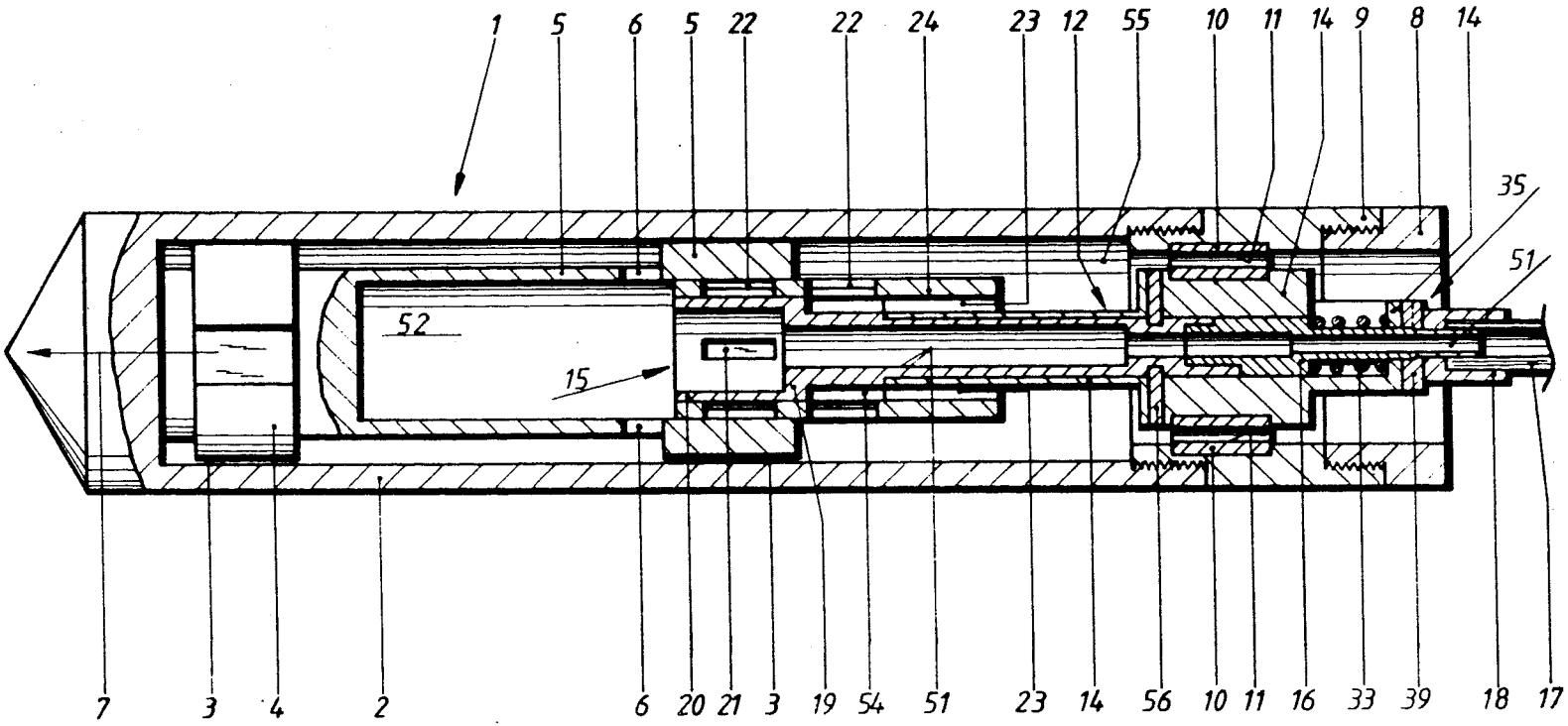
FIG. 1 shows a longitudinal section through a ram boring machine having a reversing gear arranged in its rear end comprising according to the invention a two-part control pipe and a spring-loaded locking device shown diagrammatically in the forward movement setting of the striking piston.

The ram boring machine 1 has a housing 2 in which a striking piston 4 is mounted axially displaceably with a small radial gap 3 between it and the housing 2. At its rear end the striking piston 4 has a piston skirt 5 with radial control openings 6. At the rear end of the ram boring machine 1 (viewed in the ramming direction 7) is an elastic ring 10, provided with a threaded cap 8, arranged in a screw joint 9 connecting the threaded cap 8 to the housing 2, which has numerous vent holes 11 leading out into the open air. Suspended in the ring 10 is a reversing gear 12.

Figure 7:
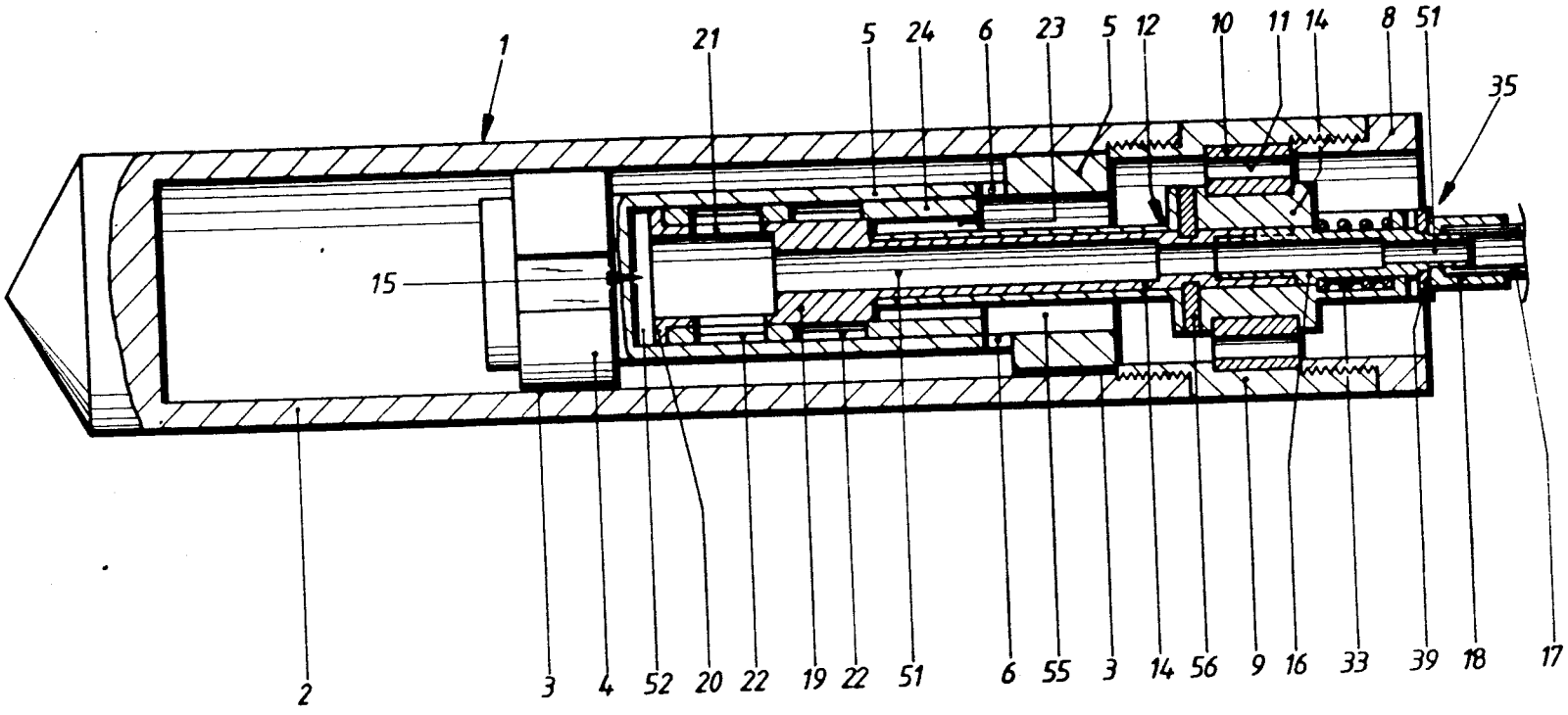
FIG. 7 shows a longitudinal section through a ram boring machine as shown in FIG. 1 but with the striking piston in the reverse movement position.
Figure 8:
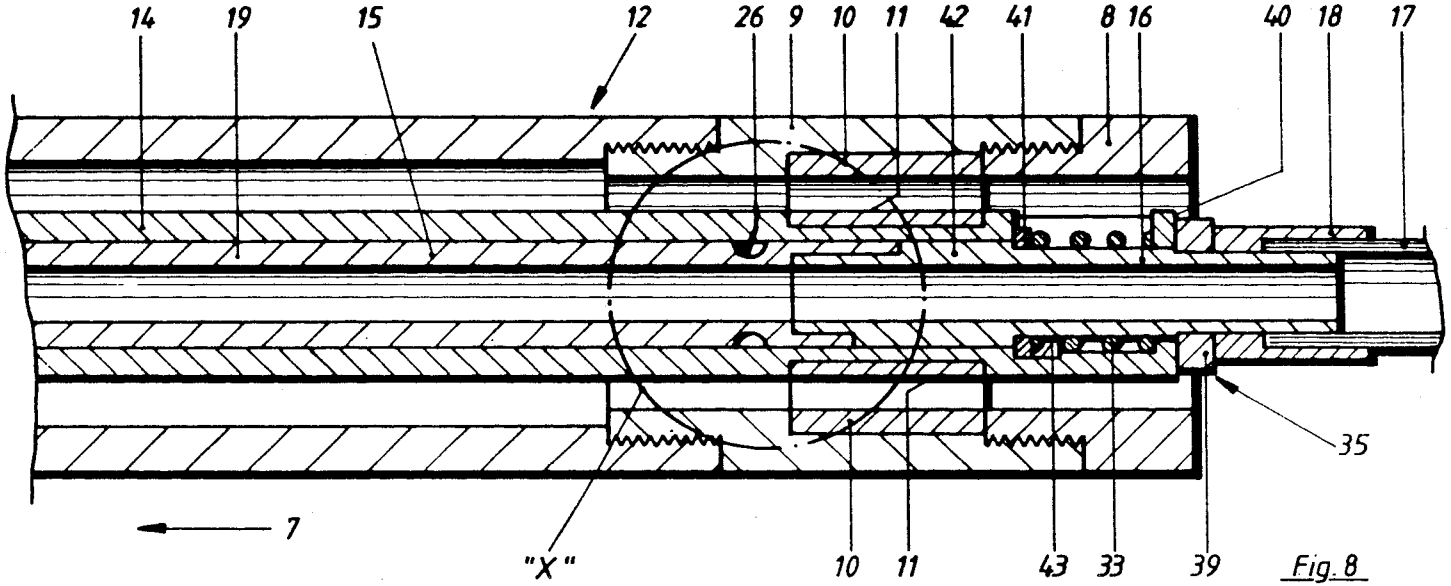
FIG. 8 shows a longitudinal section through a reversing gear suspended in a screw joint via a rubber block and having a two-part control pipe according to the invention and a pressure spring acting on a locking device.
Figure 9:
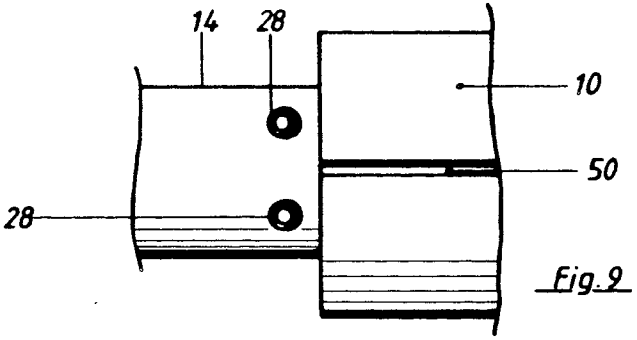
FIG. 9 shows a non-sectioned plan view of a detail indicated by "X" in FIG. 8, FIGS. 10, 11, 12 show from the front, as a longitudinal section and in a plan view a locking ring having diametrically opposed lugs.
Figure 13:
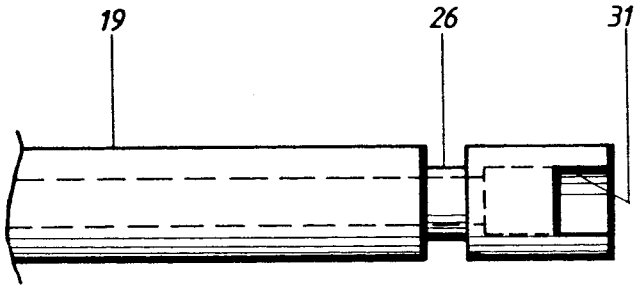
FIGS. 13, 14 show the front part of the control pipe in side elevation and as a longitudinal section.

The reversing gear 12, shown in FIG. 8, comprises a tubular bushing or bearing pipe 14 provided with control openings 22 (see FIG. 1) having a two-part control pipe 15 rotatably mounted therein. The rear part of the control pipe 15 (viewed in the ramming direction 7) is formed as a hose coupling 16; a compressed air hose 17 is attached thereto by a screw cap 18. The front part 19 of the control pipe 15 has a control head 20 of larger diameter with control openings 21 which, as will be explained below, can be brought into alignment with passage openings 22 in a control sleeve 24 (not shown in FIG. 8) connected via radial ribs 23 to the bearing pipe 14 (see FIGS. 1, 2, 6 and 7) and has two diametrically opposed flats 25 superposed on the control head 20 (see FIG. 3). The part 19 of the control pipe is provided with a circumferential groove 26 (see FIG. 13) in which, as is shown in FIG. 9, two pins 28 inserted in bores 27 in the bearing pipe 14 engage (see FIG. 18); since it is secured by the pins 28 the part 19 of the control pipe can rotate but cannot move axially.

Figure 14:
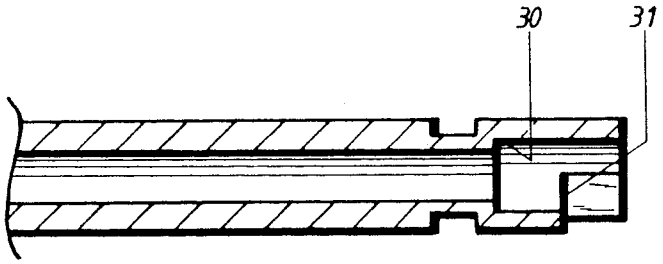
Figure 15:
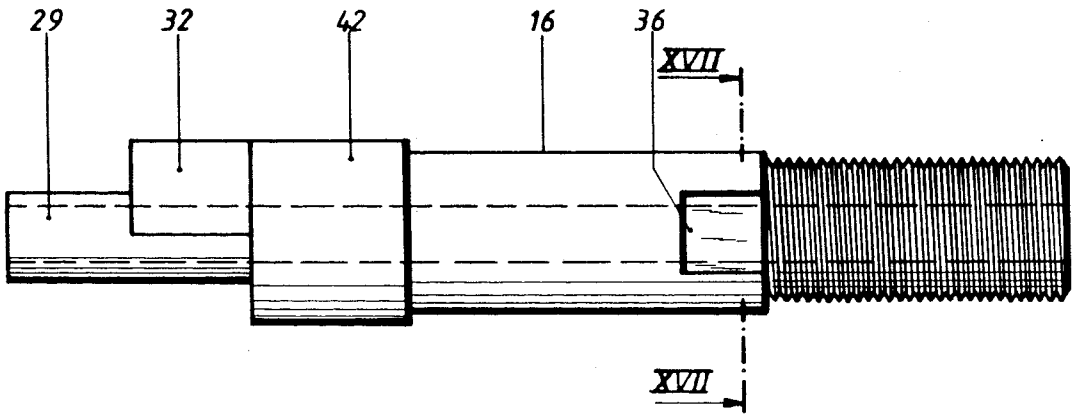
FIGS. 15, 16 show in side elevation and viewed from the left the part of the control pipe formed according to the invention as a hose coupling.

The end of the part 19 facing away from the control head 20 has, for locking to the hose coupling 16, an internal bore 30 accommodating a spigot 29 at the front end of the hose coupling 16, and for transmitting the rotary movement of the hose coupling 16 to the front part 19 of the control pipe it has an axial recess 31 into which a drive lug 32 of the hose coupling 16 projects (see FIGS. 14 and 15).

Figures 2, 3, 4, 5:
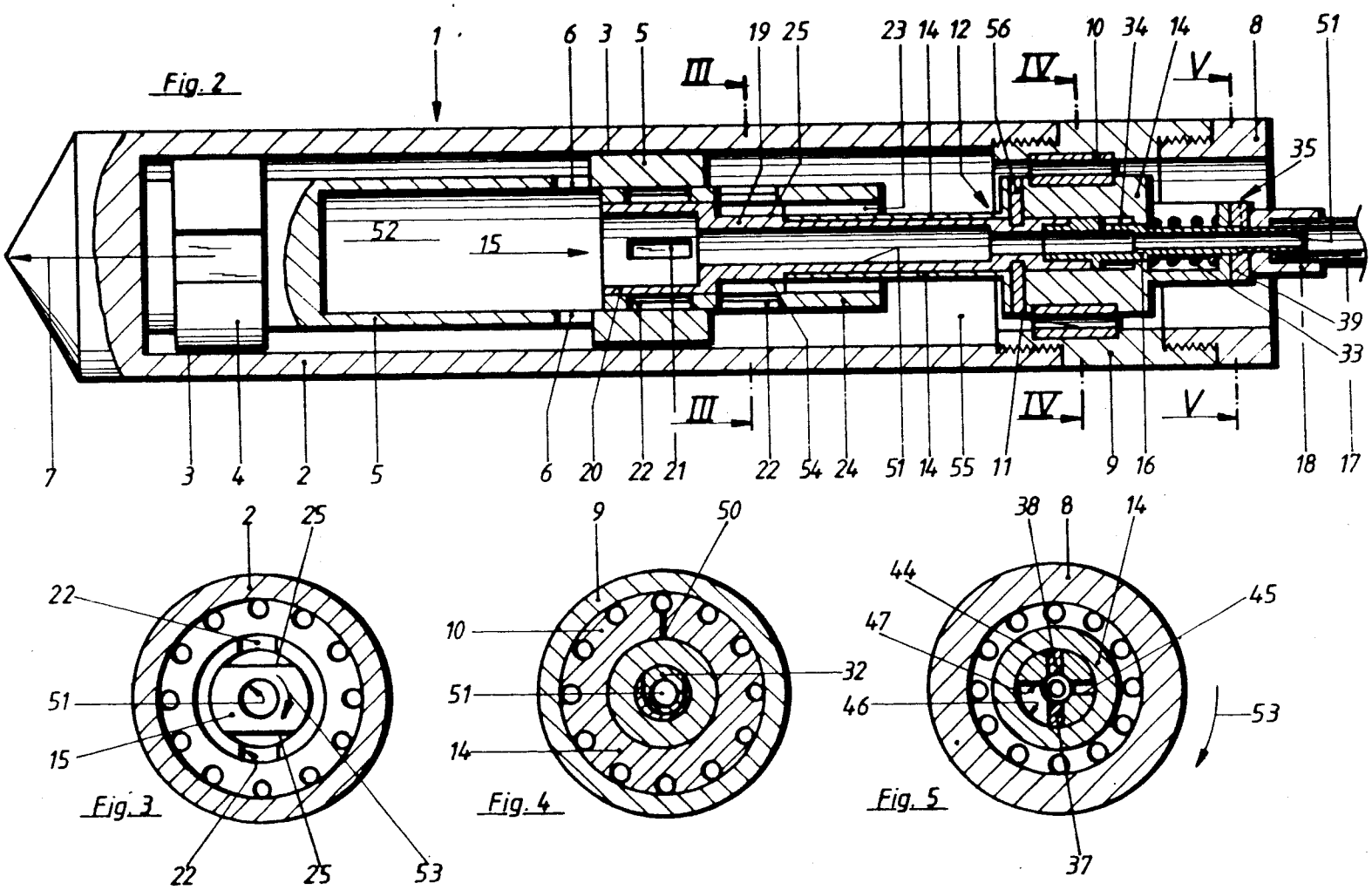
FIG. 2 shows a longitudinal section corresponding to the one in FIG. 1 through a ram boring machine additionally having a pressure chamber acting on the locking device.
FIG. 3 shows the ram boring machine shown in FIG. 2 sectioned along the line III—III.
FIG. 4 shows the ram boring machine shown in FIG. 2 sectioned along the line IV—IV.
FIG. 5 shows the ram boring machine shown in FIG. 2 sectioned along the line V—V.
Figure 11:
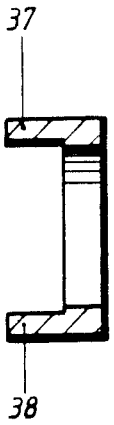
Figure 10:
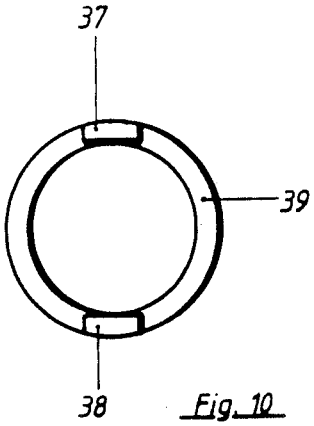
Figure 12:
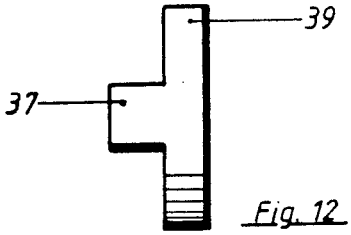
Figure 17:
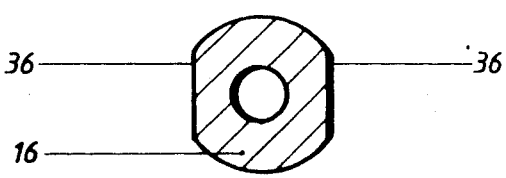
FIG. 17 shows the hose coupling shown in FIG. 15 sectioned along the line XVII—XVII.
Figure 16:
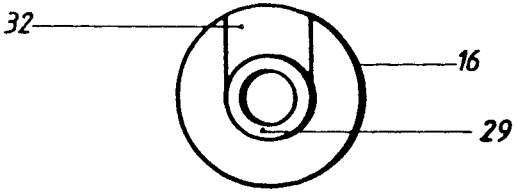

While the part 19 of the control pipe can only be rotated, for reversing the striking direction of the striking piston 4 the hose coupling 16 can in addition be displaced axially counter to the ramming direction 7. For this purpose it is necessary to unlock a locking device, which may be acted on by a spring 33 as shown in FIGS. 1, 7 and 8, or acted on by the spring 33 assisted by a pressure prevailing in a pressure chamber 34 as shown in FIG. 2, or acted on only by the pressure prevailing in the pressure chamber 34. The locking device 35 comprises a locking ring 39 pushed on to a key face 36 of the hose coupling 16 so as to be secured against rotation (see FIGS. 15 and 17), having as shown in FIGS. 10, 11, 12 two diametrically opposed lugs 37, 38 projecting axially by different amounts, and recesses (see FIG. 19) in the rear end face 40 of the bearing pipe 14 corresponding to the lugs 37, 38. The axial unlocking stroke of the hose coupling 16, in which the spring 33 is compressed, is determined by an end-position limiting disc 41. The limiting disc 41 pushed on to the hose coupling 16 and bearing against a collar 42 strikes a radially inward projection 43 in the bearing pipe 14. The axial stroke can thus be set, depending on the length of the locking lug 38 that is shorter than the stop lug 37, so that when the disc 41 meets the projection 43 the locking lug 38 is moved out of a detent groove 44 or 45 in the front face 40 of the bearing pipe 14 defining the angular setting of the control pipe 15 either for the forward or the reverse movement of the striking piston 4, while the stop lug 37 still projects into a recess 46 in the front face 40 of the bearing pipe 14.

Figure 18:
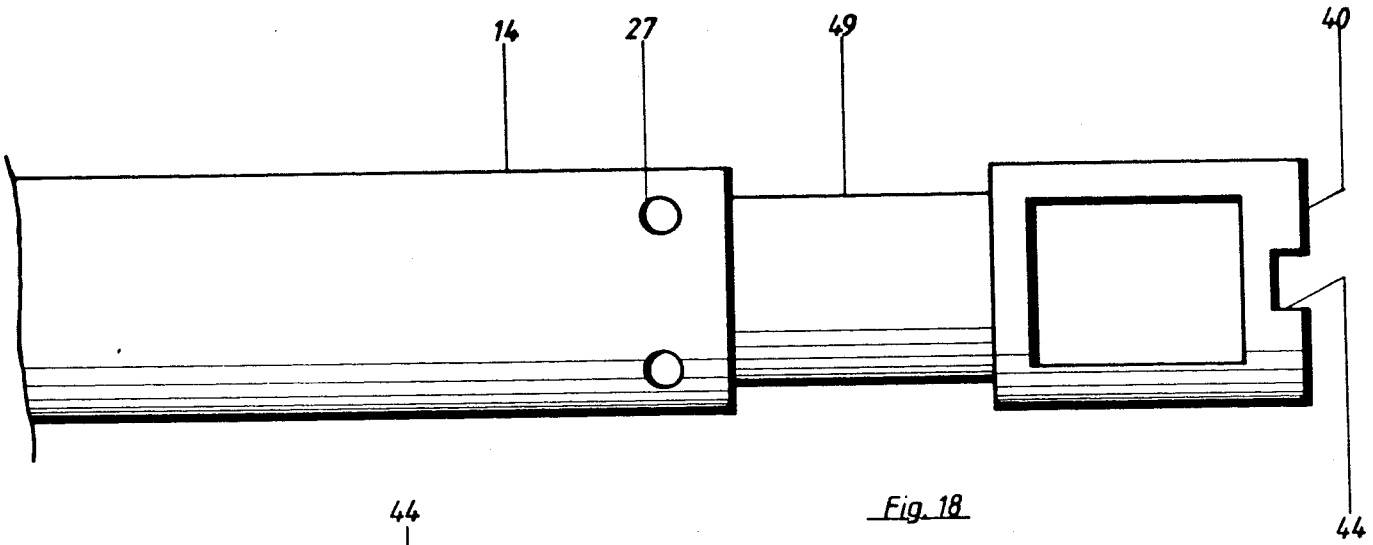
FIGS. 18, 19 20 show a bearing pipe according to the invention in side elevation, in an end elevation viewed from the right and in longitudinal section.
Figure 19:
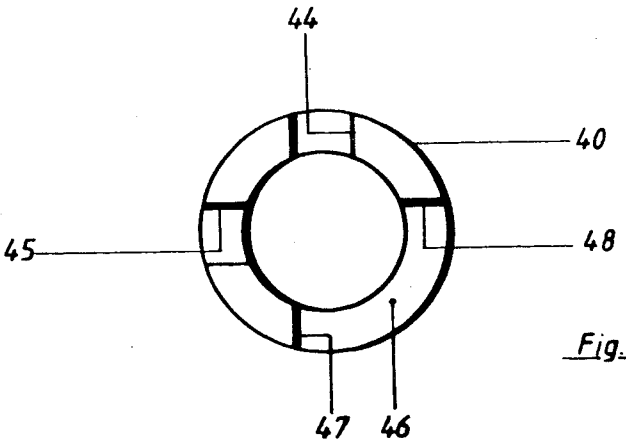
Figure 20:
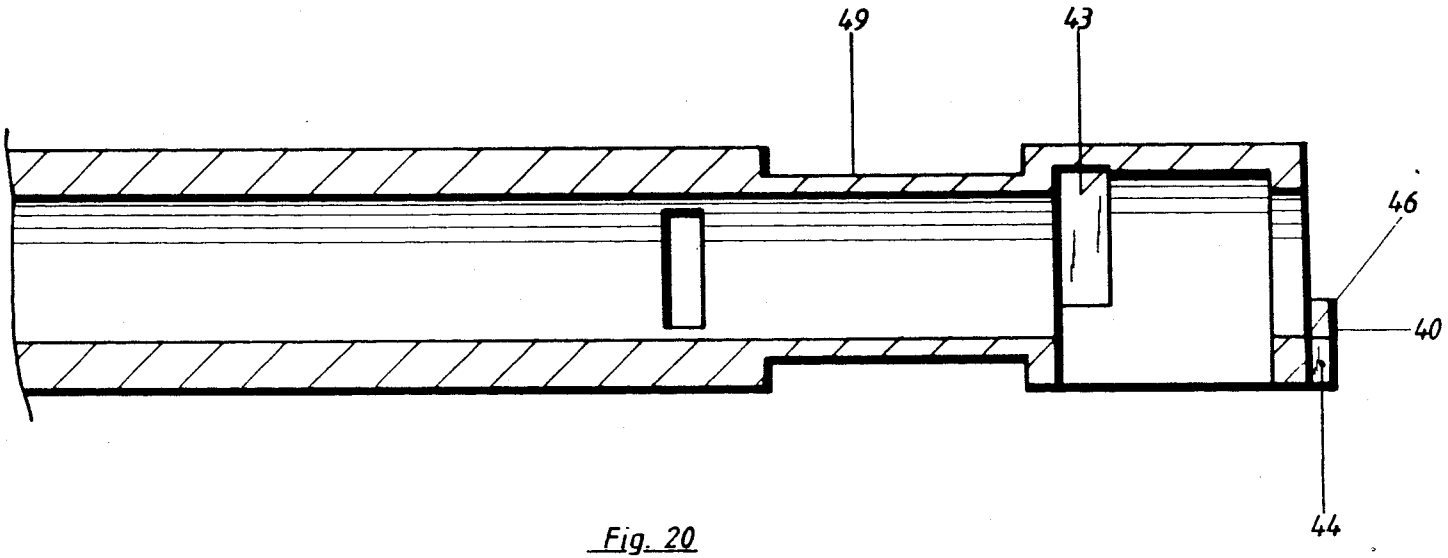

The shape of the detent grooves 44, 45 corresponding to the lugs 37, 38 of the locking ring 39 as shown in FIG. 10, or of the recess 46, which is axially deeper than the detent grooves 44, 45, is shown in FIGS. 18, 19, 20. After unlocking the locking lug 38 from—depending on the engagement position—either the detent groove 44 or the detent groove 45 at an angle of 90° thereto, and rotation of the hose coupling 16, whereby the front part 19 of the control pipe is simultaneously rotated by the drive lug 32 engaging in its axial recess 31, the stop lug 37 bears against either the outer edge 47 or 48 of the recess 46 depending on the direction of rotation. In this end position defined by the outer edges 47, 48 the locking lug 38 is in alignment with one of the two detent grooves 44, 45 and locks into the corresponding groove when traction on the hose coupling 16 is released.

So that the bearing pipe 14 accommodating the reversing gear 12 can be arranged resiliently in the housing 2 of the ram boring machine 1 by means of the elastic ring 10 it is provided with a radial recess 49 running round it. If the elastic ring—as shown in FIGS. 4 and 9—has a separating slit 50 extending over the whole length of the ring, the ring 10 only needs to be expanded radially in the region of the separating slit 50 and fitted over the recess 49. The rear screwed part 9 axially overlapping the ring 10 then seats it securely in the recess 49.

Figure 6:
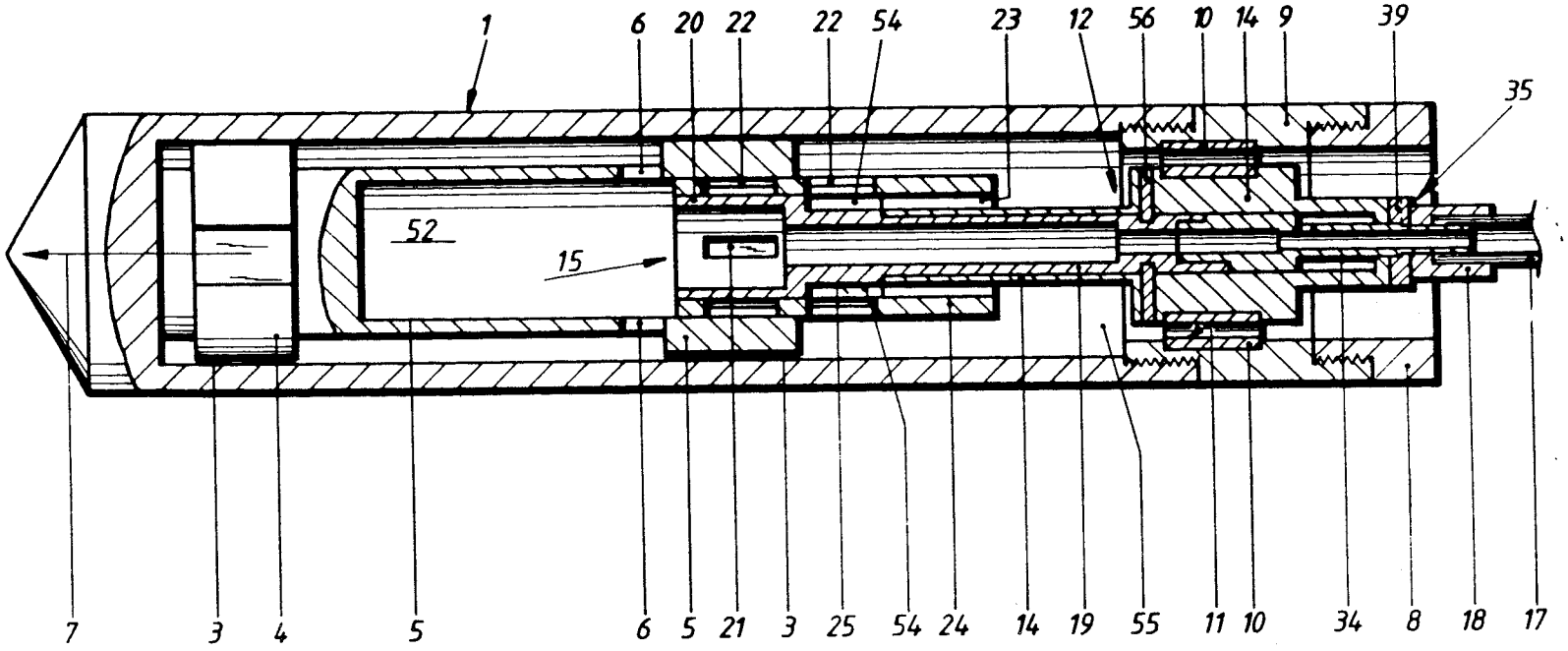
FIG. 6 shows a longitudinal section corresponding to that in FIG. 1 through a ram boring machine that has a pressure chamber for acting on the locking device.

The ram boring machines 1 shown in FIGS. 1, 2 and 6 only differ from one another in the way the locking device 35 is loaded. While, as shown in FIG. 1, the locking device 35 is held together by the compression spring 33 and, as shown in FIG. 6, by the pressure in the pressure chamber 34, FIG. 2 shows a locking device 35 loaded in combination, i.e. both by the compression spring 33 and the pressure in the pressure chamber 34. The setting of the striking piston 4 for forward movement in the ramming direction 7 is shown in FIGS. 1, 2 and 6.

By way of the compressed air hose 17, connected to a compressed air supply (not shown), compressed air enters the control head 20 via a bore 51 extending centrally right through the control pipe 15 and from there enters a working chamber 52 of the striking piston 4 and moves the piston 4 forwards in the housing 2. At the same time compressed air is expelled at the front side of the striking piston 4 and passes via the radial annular gap 3 between the housing 2 and the exterior of the striking piston 4 or the piston skirt 5 to the rear passage openings 22 of the control sleeve 24 that are not covered by the surface 5 of the piston sleeve 5, and from there into a control chamber 55 via axial grooves 54 extending between the ribs 23, and finally into the open via the vent holes 11 in the elastic ring 10. During the forward movement in the ramming direction 7 the air pressure acts on the front of the control pipe 15.

To change the control device over from the forward movement setting shown in FIGS. 1, 2 and 6 to the reverse movement setting shown in FIG. 7 the hose coupling 16 is pulled axially by hand by means of the compressed air hose 17 against the force of the spring 33 and/or against the pressure from the pressure chamber 34 counter to the ramming direction 7, and the locking device 35 is thereby released. The locking lug 38 of the locking ring 35 engaging in the detent groove 44 as shown in FIG. 5 is thus disengaged and then the hose coupling 16 is rotated in the direction of the arrow 53 until the stop lug 37 strikes the outer edge 47 of the recess 46. In this position the locking lug 38 is aligned over the detent groove 45 and then engages in it as soon as the traction ceases.

As the hose coupling 16 is rotated, the front part 19 of the control pipe, which in the embodiment shown in FIGS. 1, 2, 6 and 7 is axially secured by a radially engaging safety clamp 56, is turned by the action of the drive lug 32 by the same amount in the direction of the arrow 53 (see FIG. 3), and the control openings 21 in the control head 20 thus arrive in the position shown in FIG. 7 coinciding with the passage openings 22 in the control sleeve 24. Owing to the displacement of the striking piston 4 relative to the fixed control sleeve 24 the rear passage openings 22 in the control sleeve (viewed from the striking piston 4) are now closed by the piston skirt 5 and the control pipe 15 or 16, 19, while the passage openings closer to the striking head 4 and the control openings 21 in the control head 20 are open. The compressed air enters the control head 20 via the bore 51, and thus the working chamber 52, from which it can at the same time also enter the passage openings 21 and 22, which however are at first still closed by the piston skirt 5 and the control pipe 15. The striking piston 4 therefore first moves forwards and the air in front of its face again passes via the annular gap 3 between the housing 2 and the striking piston 4 or the piston skirt 5 to the control openings 6, which now lie behind the control sleeve 24 and thus enable the air to escape into the open via the control chamber 55 and the vent holes 11 in the elastic ring 10.

In order to change over from forward to reverse movement or vice versa the device according to the invention thus, after unlocking the hose coupling 16, merely needs the two-part control pipe 15 to be rotated through about 90° either completely to the right or completely to the left up to the stop defined by the outer edge 48 or up to the stop defined by the outer edge 47 of the recess 46 in the bearing pipe 14. In the case of turning to the left in the direction of the arrow 53 (see FIGS. 3 and 5) the ram boring machine 1 moves backwards while in the case of turning to the right to the position of engagement of the locking device 35 shown in FIG. 5 it moves forwards.

What is claimed is:

1. A ram boring machine, comprising: a tubular housing; a striking piston axially displaceable in said tubular housing and having radial control apertures; a control pipe (15) rotatably supported in said tubular housing so as to travel beyond the radial control apertures in said striking piston to control forward and return motion of said striking piston, said control pipe being made up of at least two parts including a rear part (16), viewed in the striking direction, and a front part (19), and having control apertures corresponding to those of said piston, said piston having an overtravel with respect to said control pipe; a pressure medium supply hose connected to said rear part of said control pipe; a bearing pipe (14) having control apertures (22) and being arranged in said housing so as to support said control pipe; an axially unlockable locking device actable upon by a force and provided so as to connect said rear part of said control pipe to said bearing pipe and so as to relieve said rear part from an operational pressure, said locking device being unlockable by a pull at said supply hose counter to the acting force, said rear part allowing a reversal of striking direction of said striking piston without interruption of the pressure medium; and securing means for fixing said front part to said bearing pipe so that said front part is arranged so as to completely carry the operational pressure.

2. A ram boring machine according to claim 1, wherein the front part of the control pipe is held axially non-displaceably in the bearing pipe.

3. A ram boring machine according to claim 1, wherein the locking device is spring-loaded.

4. A ram boring machine according to claim 1, which includes a pressure chamber formed in an annular gap between the bearing pipe and the rear part of the control pipe so that pressure therein acts on the locking device.

5. A ram boring machine according to claim 3, wherein the locking device is also loaded by air pressure.

6. A ram boring machine according to claim 1, wherein said locking device comprises lugs in the control pipe which project axially in the ramming direction, and grooves in the bearing pipe corresponding to the lugs.

7. A ram boring machine according to claim 1, wherein said locking device comprises a locking ring having two lugs, said locking ring being arranged non-rotatably on said rear part of the control pipe.

8. A ram boring machine according to claim 6, wherein said lugs include a stop lug and a locking lug diametrically opposed thereto.

9. A ram boring machine according to claim 6, wherein the bearing pipe has a front face with detent grooves in it and recesses ending axially deeper than said detent grooves.

10. A ram boring machine according to claim 9, wherein one of the recesses has outer edges which form stops for the stop lug which limit the rotation of the control pipe.

11. A ram boring machine according to claim 1, wherein the rear part of the control pipe engages with a drive lug in an axial recess in the front part (in the ramming direction) of the control pipe.

12. A ram boring machine according to claim 1, which includes an end position limit for the axial stroke of the rear end of the control pipe when unlocking the locking device.

13. A ram boring machine according to claim 1, wherein the bearing pipe is mounted at its rear end (viewed in the ramming direction) in a cylindrical resilient block provided with axial vent holes.

14. A ram boring machine according to claim 13, wherein the resilient block is an elastic ring having at least one separating slit extending over the whole length of the elastic ring.

* * * * *